US006439183B1

(12) United States Patent
Iwasaki et al.

(10) Patent No.: US 6,439,183 B1
(45) Date of Patent: Aug. 27, 2002

(54) VALVE TIMING ADJUSTING DEVICE

(75) Inventors: Kazutoshi Iwasaki, Nagoya; Masayasu Ushida, Okazaki; Yoshio Matsumoto, Inabe-gun, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/966,748

(22) Filed: Oct. 1, 2001

(30) Foreign Application Priority Data

Oct. 3, 2000 (JP) ..... 2000-303618

(51) Int. Cl.[7] ..... F01L 1/344

(52) U.S. Cl. ..... 123/90.17; 123/90.37

(58) Field of Search ..... 123/90.15, 90.17, 123/90.31, 90.33, 90.34, 90.37; 74/568 R; 464/1, 2, 160

(56) References Cited

U.S. PATENT DOCUMENTS 5,960,757 A 10/1999 Ushida ..... 123/90.17
6,006,709 A 12/1999 Ushida ..... 123/90.17
6,053,139 A * 4/2000 Eguchi et al. ..... 123/90.17
6,176,210 B1 * 1/2001 Lichti et al. ..... 123/90.17
6,199,524 B1 3/2001 Ushida ..... 123/90.17
6,276,321 B1 * 8/2001 Lichti et al. ..... 123/90.17

* cited by examiner

*Primary Examiner*—Weilun Lo
(74) *Attorney, Agent, or Firm*—Nixon & Vanderhye P.C.

(57) ABSTRACT

A valve timing adjusting device, in which the housing member including a chain sprocket and a shoe housing, and a vane rotor are relatively rotatable. The inner surfaces on both axial sides of the housing member and the outside surfaces on both axial sides of the vane rotor slide each other. A retard oil passage communicating with each retard hydraulic chamber is formed in an outside surface of the vane rotor on the side to which a hydraulic fluid is supplied through an oil passage formed in a camshaft. Furthermore, an advance oil passage communicating with each advance hydraulic chamber is formed at an interval of about 90 degrees at the center of an inner surface of the chain sprocket on the side to which the hydraulic fluid is supplied through a groove oil passage formed in the camshaft.

7 Claims, 7 Drawing Sheets

VALVE TIMING ADJUSTING DEVICE

CROSS REFERENCE TO RELATED APPLICATION

This application is based on and incorporates herein by reference Japanese Patent Application No. 2000-303618 filed on Oct. 3, 2000.

BACKGROUND OF THE INVENTION

1. Field of the Invention

The present invention relates to a valve timing adjusting device for changing a valve timing of at least one of an intake valve and an exhaust valve of an internal combustion engine.

2. Description of Related Art

There has been conventionally known a vane-type valve timing adjusting device, in which a vane member rotating together with a camshaft is relatively rotatably housed in a housing member which is driven by a power from an engine crankshaft. The phase of the vane member with respect to the housing member, that is, a phase difference caused by relative rotation between the crankshaft and the camshaft, is hydraulically controlled, so that the valve timing of at least one of the intake valve and the exhaust valve is controlled.

In the valve timing adjusting device disclosed in JP-A-9-60507, within at least one of both end faces in the axial direction of the vane member, a groove passage for supplying the hydraulic fluid to a retard hydraulic chamber or an advance hydraulic chamber is formed.

In the valve timing adjusting device disclosed in JP-A-9-60507, the groove passage formed in at least one of the end faces of the vane member is not directly connected with the retard hydraulic chamber or the advance hydraulic chamber. The passage for supplying the hydraulic fluid from the groove passage into the retard hydraulic chamber or the advance hydraulic chamber is a hole passage formed in the vane member, through to be connected with the groove passage, by cutting with, for example, a drill.

The hole passage to be made in the vane member can not be formed by a molding process such as sintering or die-casting. Therefore, there will arise such a problem that it is necessary to use another hole passage forming process than the molding process, which will increase the number of processes for manufacturing the vane member. Besides, if drilling is used to form the hole passage, there will be left cutting chips and burrs, so that the addition of processes are needed for removing the chips and burrs.

Furthermore, when forming the groove passage in both end faces in the axial direction of the vane member, it will become necessary to form an oil passage through the vane member for the purpose of feeding the hydraulic fluid to the groove passage formed in the end face opposite to the hydraulic fluid supply side. Therefore, the number of manufacturing processes is increased.

SUMMARY OF THE INVENTION

An object of the invention to reduce the number of manufacturing process of a valve timing adjusting device.

According to a first aspect of the present invention, a retard passage and an advance passage are formed in at least one of an inner surface of a housing member and an outside surface of a vane member without forming a hole passage by drilling in the housing member and the vane member.

The retard passage and the advance passage are formed in at least one of the inner surface of the housing member and the outside surface of the vane member to which a hydraulic fluid is supplied from a fluid supply passage. Therefore, there is no need to form a hole through the housing member or the vane member in the axial direction, which connects the retard passage and the advance passage with the fluid supply passage.

The retard passage and the advance passage can be formed in at least one of the housing member and the vane member through the forming process such as sintering and die-casting. Therefore, it is possible to dispense with the process for forming, separately from the molding process, the retard passage and the advance passage by cutting or other.

According to a second aspect of the present invention, the retard passage is formed in one of the inner surface of the housing member and the outside surface of the vane member, and the advance passage is formed in the other member. The retard passage and the advance passage, therefore, can easily be formed.

To increase the torque to be received from the fluid pressure by the housing member and the vane member, the number of vanes must be increase. To gain a desired range of relative rotational angle, the vane and the shoe must be decreased in thickness in the rotation direction. With the vane and the shoe decreased in thickness rotation direction, it is desirable to mount a seal member on the forward end on the sliding side of the vane and the shoe decreased in thickness in the rotation direction, for the purpose of preventing leakage of the hydraulic fluid from the retard chamber and the advance chamber. The seal member mounted on the shoe, however, receives a centrifugal force in the radial direction in which the seal member will move away from the outer peripheral surface of the vane member. Therefore, if the seal member mounted on the shoe receives the fluid pressure further radially outwardly from the retard passage or the advance passage, the pressure pressing the seal member against the vane member will decrease, causing the hydraulic fluid to easily leak.

According to a third aspect of the present invention, in whichever phase of relative rotation the vane member is with respect to the housing member, the seal member mounted on the shoe does not reach either of the communication point of the retard chamber of the retard passage and the communication point of the advance chamber of the advance passage. The seal member mounted on the shoe does not receive the fluid pressure on the radially outer side from the retard passage or the advance passage, thereby preventing the hydraulic fluid leakage.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
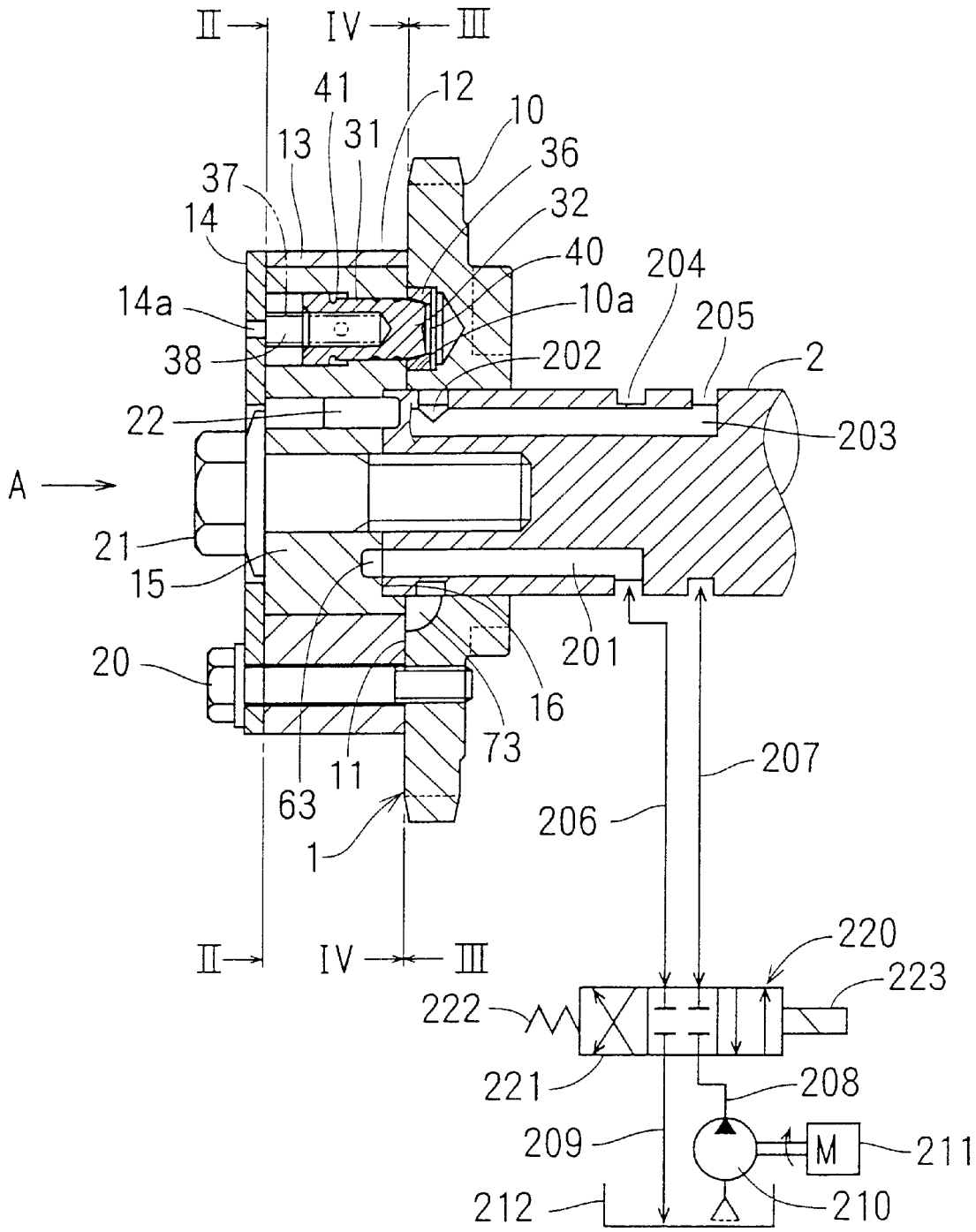
FIG. 1 is a longitudinal cross-sectional view showing a valve timing adjusting device (first embodiment)
Figure 2:
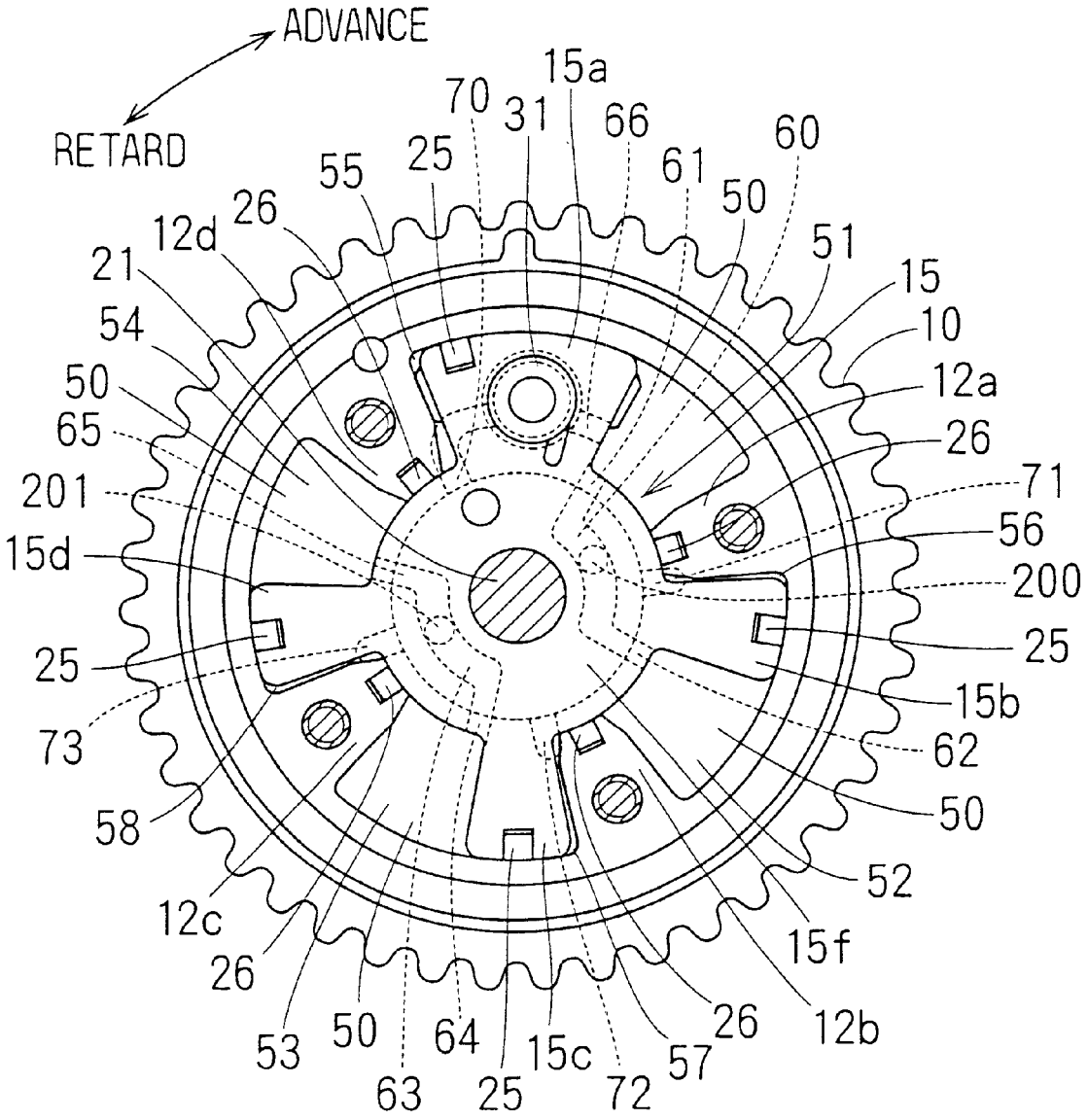
FIG. 2 is a cross-sectional view taken along line II—II of FIG. 1 (first embodiment)

FIGS. 1 and 2 show a valve timing adjusting device 1 for engine according in a first embodiment. FIG. 1 is a longitudinal cross-sectional view taken along a line passing through a stopper piston 31, a bolt 21 and an oil passage 201 shown in the cross sectional view of FIG. 2. A valve timing adjusting device 1 is of a hydraulic control type for controlling the intake valve timing.

A chain sprocket 10 shown in FIG. 1 as a driving rotor is coupled with a crankshaft as the driving shaft of an engine (not illustrated) and driven by a power transmitted through a chain (not illustrated), and rotates in synchronization with the crankshaft. A camshaft 2 as a driven shaft is driven by a power from the chain sprocket 10, and opens/closes an intake valve (not illustrated). The camshaft 2 rotates with respect to the chain sprocket 10 by a specific phase difference. The chain sprocket 10 and the camshaft 2 rotate clockwise as viewed in the direction of an arrow A shown in FIG. 1. This direction of rotation is hereinafter referred as an advance direction.

The chain sprocket 10 and a shoe housing 12 form a housing member, which is secured coaxially by a bolt 20. The shoe housing 12 includes a peripheral wall 13 and a front plate 14, and is separated from the chain sprocket 10. The shoe housing 12, as shown in FIG. 2, includes shoes 12*a*, 12*b*, 12*c* and 12*d* as partition parts formed in a trapezoidal shape and nearly equally spaced in the rotation direction. The inner peripheral surfaces of the shoes 12*a*, 12*b*, 12*c* and 12*d* are formed circular in cross section. The shoes 12*a*, 12*b*, 12*c* and 12*d* are cut out at both side corners in the rotation direction which face the boss portion 15*f* of the vane rotor 15 so as not to contact the vanes 15*a*, 15*b*, 15*c* and 15*d*. In four spaces formed in the rotation direction by the shoes 12*a*, 12*b*, 12*c* and 12*d*, there are formed fan-shaped housing chambers 50 in which the vanes 15*a*, 15*b*, 15*c* and 15*d* are housed.

The vane rotor 15 has the boss portion 15*f* and the vanes 15*a*, 15*b*, 15*c* and 15*d* nearly equally spaced in the rotation direction on the outer peripheral side of the boss portion 15*f*. The vanes 15*a*, 15*b*, 15*c* and 15*d* are rotatably housed in each housing chamber 50. Each of these vanes 15*a*–15*d* divides each housing chamber 50 into two chambers: the retard hydraulic chamber and the advance hydraulic chamber. The arrows indicating the retard and advance directions in FIG. 2 indicates the retard and advance directions of the vane rotor 15 with respect to the shoe housing 12. The vane rotor 15 as the driven rotor, which is in contact with the end face of the camshaft 2 in the direction of the rotating shaft thereof, and is integrally secured to the camshaft 2 by the bolt 21. The position in the rotation direction of the vane rotor 15 with respect to the camshaft 2 is determined by a pin 22 shown in FIG. 1.

The vane rotor 15 and the housing member including the chain sprocket 10 and the shoe housing 12 are relatively rotatable. The both axial inside surfaces of the housing member and the both axial outside surfaces of the vane rotor 15 are set to face and slide over each other.

These seal members 25 and 26, as shown in FIG. 2, are installed in a clearance formed between the shoe housing 12 and the vane rotor 15 which radially face each other. The seal member 25 fits in each of recesses formed in the vanes 15*a*, 15*b*, 15*c* and 15*d*. The seal member 26 fits in a recess formed in the inner peripheral wall of each of the shoes 12*a*, 12*b*, 12*c* and 12*d*. Between the outer peripheral wall of the vane rotor 15 and the inner peripheral wall of the peripheral wall 13, a very little clearance is provided. The seal members 25 and 26 function to prevent the hydraulic fluid from leaking through this clearance between the retard and advance hydraulic chambers. The seal members 25, 26 are radially pressed by urging force of a long plate leaf spring against opposite sliding surfaces, respectively. As shown in FIG. 1, the stopper piston 31 as a contact portion is cylindrically formed and is housed in the vane 15*a*, being slidable in the axial direction. The fitting ring 36 as a contacted portion is pressed and held in the recess 10*a* formed in the chain sprocket 10. The stopper piston 31 can be fitted in contact with the fitting ring 36. Since the stopper piston 31 and the fitting ring 36 are tapered on the contact side, the stopper piston 31 can smoothly fit into the fitting ring 36. A spring 37as a pressing means for pressing the stopper piston 31 toward the fitting ring 36. The stopper piston 31, the fitting ring 36 and the spring 37 work as a restraining means.

The pressure of the hydraulic fluid to be supplied to the hydraulic chambers 40 and 41 works the stopper piston 31 to move out of the fitting ring 36. The hydraulic chamber 40 communicates with the advance hydraulic chamber 55, and the hydraulic chamber 41 communicates with the retard hydraulic chamber 51. The leading end portion 32 of the stopper piston 31 can fit into the fitting ring 36 when the vane rotor 15 is in the most retarded position with respect to the shoe housing 12. The rotation of the vane rotor 15 with respect to the shoe housing 12 is restrained with the stopper piston 31 fitted into the fitting ring 36.

When the vane rotor 15 rotates from the most retarded position to the advance side with respect to the shoe housing 12, the stopper piston 31 deviates from the fitting ring 36 in the rotation direction, thereby making it impossible to fit the stopper piston 31 into the fitting ring 36.

A communicating passage 14*a* formed in the front plate 14 and the housing hole 38 mutually communicate with each other when the vane rotor 15 is in the most retarded position with respect to the shoe housing 12. Because the communicating passage 14*a* is opened to the atmosphere, the reciprocating movement of the stopper piston 31 in the most retard position is not interfered.

As shown in FIG. 2, the retard hydraulic chamber 51 is formed between the shoe 12*a* and the vane 15*a*, a retard hydraulic chamber 52 is formed between the shoe 12*b* and the vane 15*b*, a retard hydraulic chamber 53 is formed between the shoe 12*c* and the vane 15*c*, and the retard hydraulic chamber 54 is formed between the shoe 12*d* and the vane 15*d*. Furthermore, the advance hydraulic chamber 55 is formed between the shoe 12*d* and the vane 15*a*, an advance hydraulic chamber 56 is formed between the shoe 12*a* and the vane 15*b*, an advance hydraulic chamber 57 is formed between the shoe 12*b* and the vane 15*c*, and the advance hydraulic chamber 58 is formed between the shoe 12*c* and the vane 15*d*.

As shown in FIG. 1, annular groove oil passages 204 and 205 are formed in the outer peripheral wall of the camshaft 2. Furthermore, also formed in the camshaft 2 are oil passages 200 and 201 (for the oil passage 200, see FIG. 2) which communicate with the groove oil passage 204, and an oil passage 203 extending in the axial direction to communicate with the groove oil passage 205. The oil passages 200 and 201 reach the front end face of the camshaft 2. The oil passage 203 communicates with the annular groove oil passage 202 formed in the outer peripheral wall on the front side of the camshaft 2. The oil passages 200, 201, 202, 203, 204 and 205 form a fluid supply passage.

The groove oil passage 204 is connected with a changeover valve 220 through an oil passage 206, and the groove oil passage 205 is also connected with the changeover valve 220 through an oil passage 207. An oil supply passage 208 is connected with an oil pump 210 which is driven by an engine power source 211; and the oil drain passage 209 is open toward the drain 212. The oil pump 210 delivers the hydraulic fluid from the drain 212 to each hydraulic chamber through the changeover valve 220.

A valve member 221 of the changeover valve 220 is pressed in one direction by a spring 222, and is reciprocally moved by controlling the supply of the electric current to the solenoid 223. The supply of the electric current to the solenoid 223 is controlled by means of the engine control unit (ECU). With the reciprocating motion of the valve member 221, the combinations of opening and closing of the oil passage 206 and 207 communicating with the oil supply passage 208 and the oil drain passage 209 are changed over.

Figure 3:
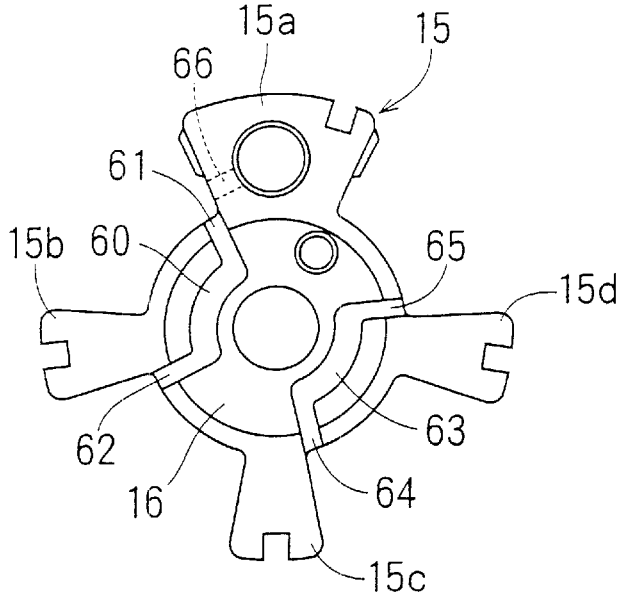
FIG. 3 is a view showing an outside surface of a vane rotor as viewed along line III—III in FIG. 1 (first embodiment)

In a read end surface 16 of the vane rotor 15, retard oil passages 60 and 63 as retard passages are formed as shown in FIG. 3. The retard oil passage 60 has distributing oil passages 61 and 62, communicating with the oil passage 200. The distributing oil passage 61 communicates with the retard hydraulic chamber 51, and the distributing oil passage 62 communicates with the retard hydraulic chamber 52. The retard oil passage 63 has distributing oil passages 64 and 65, communicating with the oil passage 201. The distributing oil passage 64 communicates with the retard hydraulic chamber 53, and the distributing oil passage 65 communicates with the retard hydraulic chamber 54. The distributing oil passages 61, 62, 64 and 65 open at the root of each vane. Also, in the vane 15*a*, an oil passage 66 (shown in FIG. 2) is formed to communicate with the retard hydraulic chamber 51 and the hydraulic chamber 41.

Figure 4:
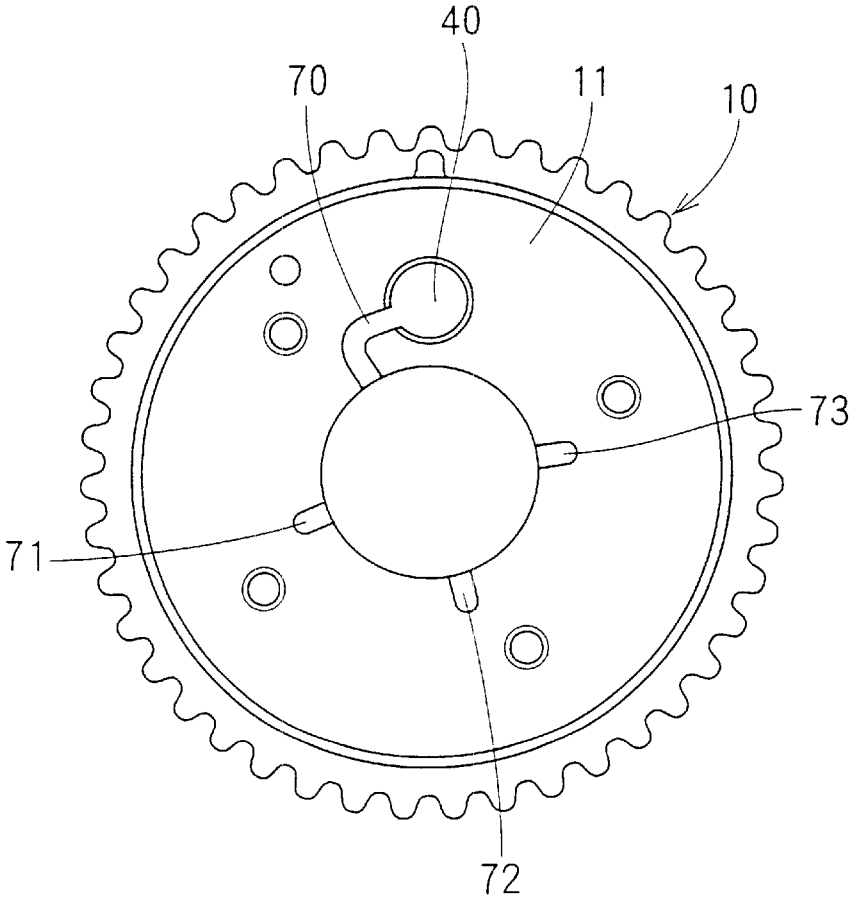
FIG. 4 is a view showing an inner surface of a chain sprocket as viewed along line IV—IV in FIG. 1 (first embodiment)

Advance oil passages 70, 71, 72 and 73 as advance passages are formed, as shown in FIG. 4, at an interval of about 90 degrees in the central part of the front side inner surface 11 of the chain sprocket 10. The advance oil passage 70 communicates with the advance hydraulic chamber 55 and the hydraulic chamber 40; the advance oil passage 71 communicates with the advance hydraulic chamber 55 and the hydraulic chamber 40; the advance oil passage 71 communicates with the advance hydraulic chamber 56; the advance oil passage 72 communicates with the advance hydraulic chamber 57; and the advance oil passage 73 communicates with the advance hydraulic chamber 58.

Because of the above-described oil-passage arrangement, the hydraulic fluid can be supplied from the oil pump 210 to the retard hydraulic chambers 51, 52, 53, and 54, the retard hydraulic chambers 55, 56, 57 and 58, and the hydraulic chambers 40 and 41, and also can be discharged from each hydraulic chamber to the drain 212.

Upon the supply of the hydraulic fluid into each retard hydraulic chamber or each advance hydraulic chamber, and further to the hydraulic chamber 41 or the hydraulic chamber 40, the stopper piston 31 receives a force on the left side in FIG. 1. Therefore, the stopper piston 31 moves out of the fitting ring 36 against the force of the spring 37, there by disconnecting the shoe housing 12 from the vane rotor 15. The vane rotor 15, therefore, rotates with respect to the shoe housing 12 by the use of the hydraulic fluid exerted to the advance hydraulic chambers 51, 52, 53 and 54 and the advance hydraulic chambers 55,56, 57 and 58, there by adjusting the relative phase difference of the camshaft 2 in relation to the crankshaft.

In the first embodiment, there are formed the retard oil passages 60 and 63 which communicate with each retard hydraulic chamber, in the rear side outside surface 16 of the vane rotor 15; and also the advance oil passages 70, 71, 72 and 73, which communicate with each advance hydraulic chamber, are formed in the front side inner surface 11 of the chain sprocket 10.

In the surface of the chain sprocket 10 and the vane rotor 15, the retard oil passage communicating with the oil passages 200, 201 formed in the camshaft 2 and each retard hydraulic chamber, and the advance oil passage communicating with the groove oil passage 202 formed in the camshaft 2 and each advance hydraulic chamber are formed. Therefore, the advance oil passage and the retard oil passage can be formed by the molding process for molding the chain sprocket 10 and the vane rotor 15 by sintering or diecasting. According to the above-described process, the cutting process for forming the retard and advance oil passages can be omitted, thereby decreasing component count and manufacturing cost. The chain sprocket 10 can be formed through forging or pressing.

The shoes 12*a*, 12*b*, 12*c* and 12*d* are cut out at both corner portions in the direction of rotation which face the boss portion 15*f* of the vane rotor 15 so as not to contact the vanes 15*a*,15*b*, 15*c* and 15*d*. Therefore, the advance oil passages 70, 71, 72 and 73 formed in the chain sprocket 10 communicate with the advance hydraulic chambers 55, 56, 57 and 58 even when the vane rotor 15 has reached the most retarded position with respect to the shoe housing 12. Similarly, even when the vane rotor 15 has reached the most advanced position with respect to the shoe housing 12, the retard oil passages 60, 63 formed in the vane rotor communicate with the retard hydraulic chambers 51, 52, 53 and 54.

The seal member 25 fits in each vane if the valve timing adjusting device 1 is downsized and the width of each vane in the rotation direction is decreased, and therefore can constantly slide over the inner surface of the peripheral wall 13. Therefore, the hydraulic fluid can be prevented from leaking between the retard hydraulic chamber and the advance hydraulic chamber separated by each vane.

The seal member 26 fits in each shoe if the valve timing adjusting device 1 is downsized and the width of each shoe in the rotation direction is decreased, and therefore can constantly slide over the outer surface of the boss portion 15*f*. Therefore, it is possible to prevent hydraulic fluid leakage between the retard hydraulic chamber and the advance hydraulic chamber of the housing chamber 50 which are adjacently located in the rotation direction.

The seal member 26 mounted in each partition section does not reach the communication point between the retard oil passages 60, 63 formed in the rear end surface 16 of the vane rotor 15 and each retard hydraulic chamber, and the communication point between the advance oil passages 70, 71, 72, 73 formed in the inner surface 11 of the chain sprocket 10 and each advance hydraulic chamber. The seal member 26 mounted in each partition section, receiving no fluid pressure toward the radially outer side from the retard oil passage and the advance passage, reliably contacts the outer peripheral surface of the vane rotor 15. Therefore, hydraulic fluid leakage can be prevented.

(Second Embodiment)

Figure 5:
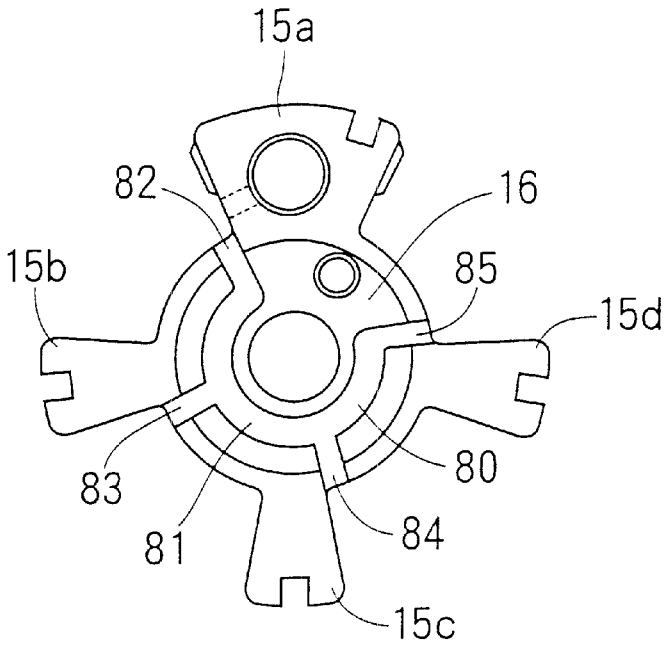
FIG. 5 is a view showing an outside surface of a vane rotor (second embodiment)

A second embodiment is shown in FIG. 5. It should be noted that substantially same members as those in the first embodiment are designated by the same reference numerals.

In the second embodiment, there is formed, in the camshaft 2, only one oil passage through which the hydraulic fluid can be supplied to the retard hydraulic chamber. A circular retard oil passage 80 communicating with the oil passage is formed in the outside surface 16 of the vane rotor 15 on the side of direction of rotation axis to which the hydraulic fluid is supplied from the camshaft 2. The retard oil passage 80 has distributing oil passages 81, 82, 83, 84 and 85 communicating with each retard hydraulic chamber.

(Third Embodiment)

Figure 6:
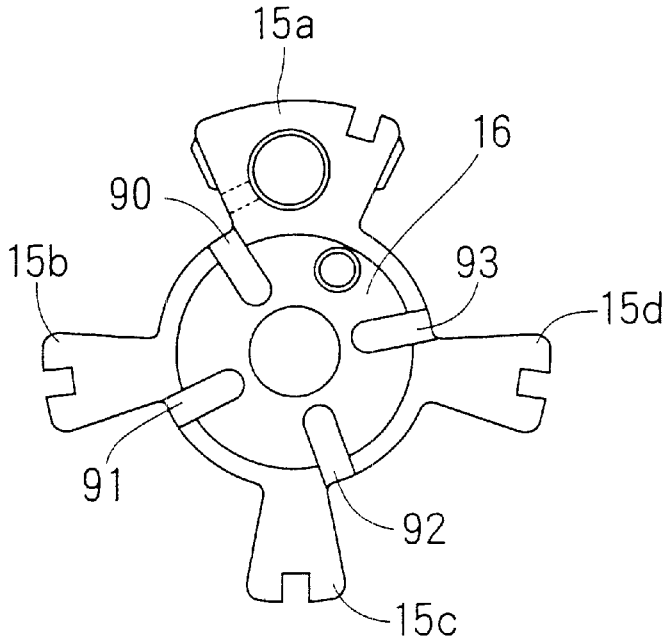
FIG. 6 is a view showing an outside surface of a vane rotor (third embodiment)

A third embodiment is shown in FIG. 6. In the third embodiment, fouroil passages for supplying the hydraulic fluid to each retard hydraulic chamber are formed in the camshaft 2; the retard oil passages 90, 91, 92 and 93 communicating with these four oil passages are also formed in the outside surface 16 of the vane rotor 15. The retard oil passages 90, 91, 92 and 93 communicate with the retard hydraulic chambers, respectively.

(Fourth Embodiment)

Figure 7:
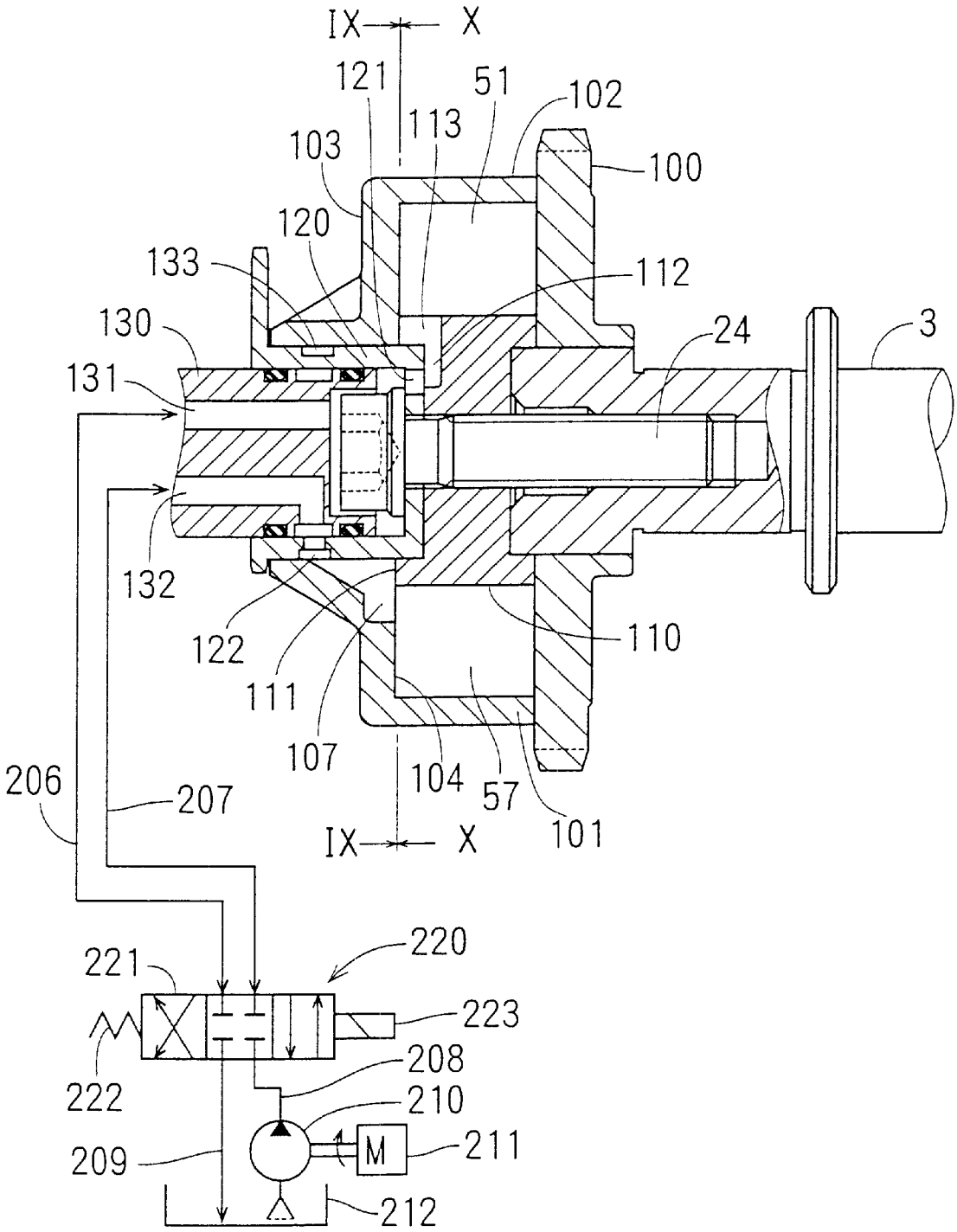
FIG. 7 is a longitudinal cross-sectional view showing a valve timing adjusting device including a retard hydraulic chamber and an advance hydraulic chamber (fourth embodiment)
Figure 8:
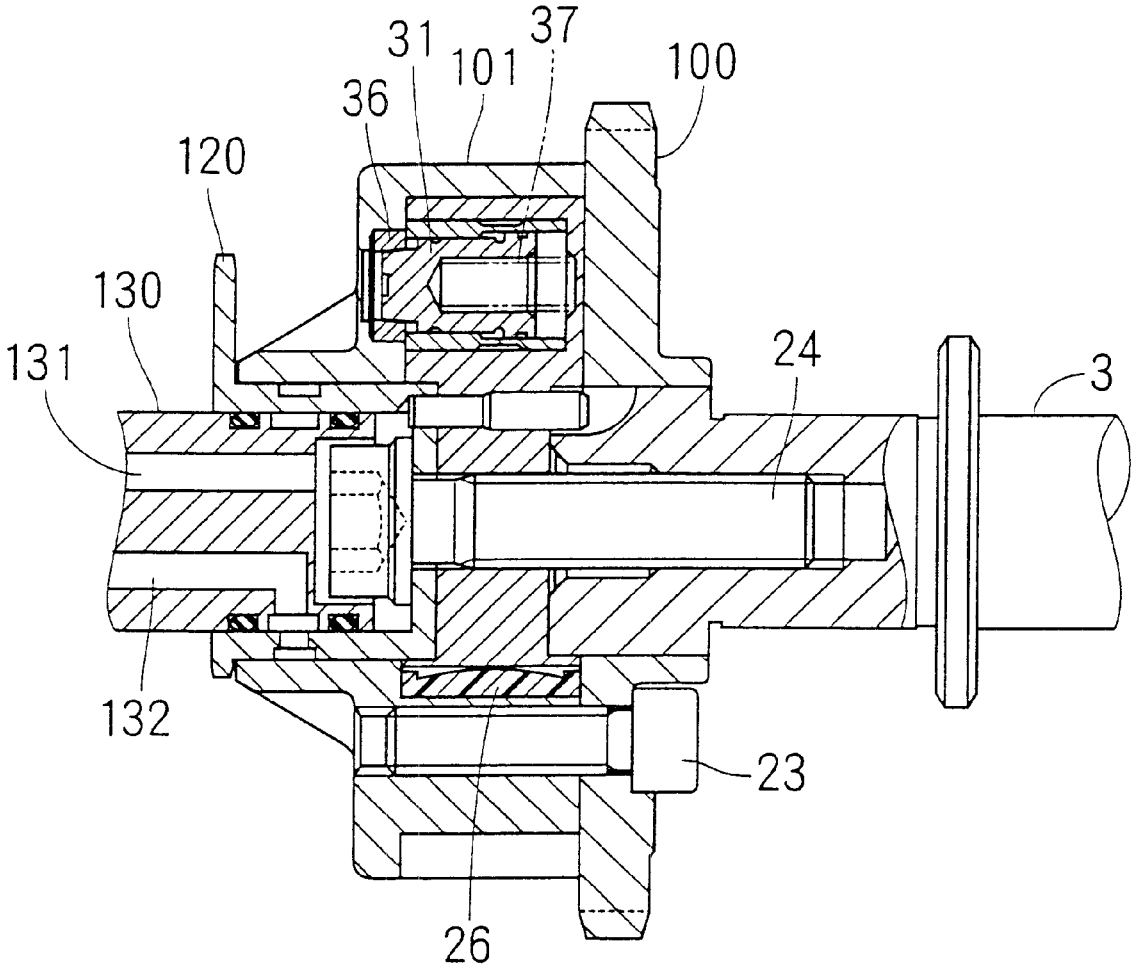
FIG. 8 is a longitudinal cross-sectional view showing the valve timing adjusting device including a stopper piston and a seal member (fourth embodiment)

A fourth embodiment of the valve timing adjusting device is shown in FIGS. 7 and 8. FIG. 7 is a longitudinal cross-sectional view taken along line passing through the retard hydraulic chamber 51, the bolt 24 and the advance hydraulic chamber 57. FIG. 8 is a longitudinal cross-sectional view taken along line passing through the stopper piston 31, the bolt 24, the seal member 26 and the bolt 23. Substantially same members as those in the first embodiment are designated by the same reference numerals.

A chain sprocket 100 is coupled with a shoe housing 101 by a bolt 23 to form a housing member so as to rotate with together. The shoe housing 101 has a peripheral wall 102 and a front plate 103, which are formed as a single body. The camshaft 3, a vane rotor 110 as the vane member, and a bushing 120 are coupled by a bolt 24 to rotate as a single body. A passage member 130 is secured to a support member (not illustrated). The passage member 130 fits in a bushing 120 at a front side of the vane rotor 110, and slides with respect to the bushing 120.

The passage member 130 has an oil passage 131 which communicates with the oil passage 206, and an oil passage 132 which communicates with the oil passage 207. The oil passages 131, 132 constitute the fluid supply passage. The oil passage 131 is open to the rear end portion of the passage member 130. The oil passage 132 communicates with an annular groove oil passage 133 formed in the outer periphery of the rear end portion of the passage member 130. An annular groove oil passage 122 is formed in the outer peripheral wall of the bushing 120. The groove oil passage 122 communicates with the groove oil passage 133 at a plurality of points.

Figure 9:
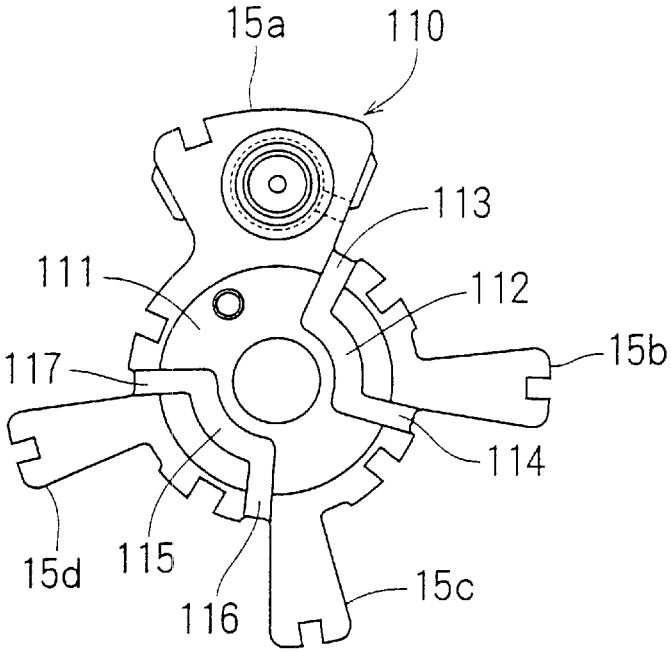
FIG. 9 is a view showing an outside surface of a vane rotor taken along line IX—IX in FIG. 7 (fourth embodiment)

As shown in FIG. 9, retard oil passages 112, 115 as retard passages are formed in the front side outside surface 111 of the vane rotor 110, to which fluid is supplied from the passage member 130. The retard oil passage 112 communicates with the oil passage 131 through a through hole 121 which is formed in the bushing 120. The retard oil passage 115 communicates with the oil passage 131 through a through hole (not illustrated) formed in the bushing 120. The retard oil passage 112 has distributing oil passages 113, 114; and the retard oil passage 115 has distributing oil passages 116, 117. The distributing oil passages 113, 114, 116 and 117 communicate with retard hydraulic chambers.

Figure 10:
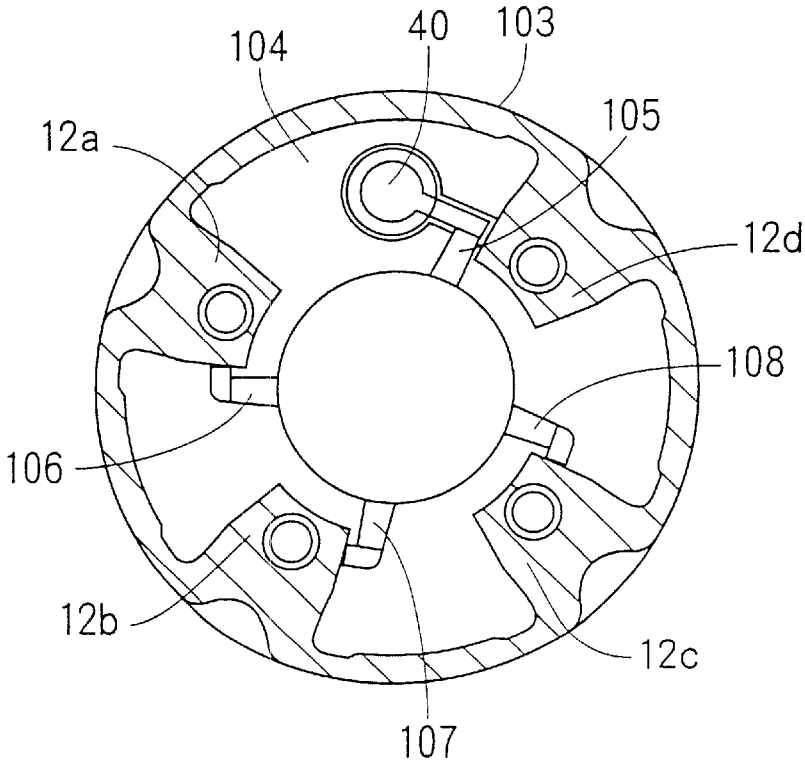
FIG. 10 is a view showing an inside surface of a front plate taken along line X—X in FIG. 7 (fourth embodiment).

As shown in FIG. 10, advance oil passages 105, 106, 107 and 108 as advance passages communicating with the advance hydraulic chambers are formed in the rear side inner surface 104 of the front plate 103, to which the hydraulic fluid is supplied from the passage member 130.

In the fourth embodiment, the retard oil passages 112, 115 through which the hydraulic fluid can be supplied to each retard hydraulic chamber are formed in the front side outside surface 111 of the vane rotor 110, to which the hydraulic fluid is supplied from the passage member 130. Also, the advance oil passages 105, 106, 107 and 108 communicating with each advance hydraulic chamber are formed in the rear side inner surface 104 of the front plate 103, to which the hydraulic fluid can be supplied from the passage member 130.

The retard oil passage connecting the oil passage 131 formed in the passage member 130 with each retard hydraulic chamber, and the advance oil passage connecting the oil passage 132 formed in the passage member 130 with each advance hydraulic chamber are formed in the surface of the front plate 103 and the vane rotor 110. Therefore, it is possible to dispense with the cutting or other process for forming the oil passages by adopting the sintering or die-casting process, thereby enabling the reduction of the manufacturing process and the manufacturing cost. The shoe housing 101 having the front plate 103 can be formed by a forging or pressing process.

(Modifications)

In the above-described embodiments, the advance oil passage is formed in the inner surface of the housing member, to which the hydraulic fluid is supplied, and the retard oil passage is formed in the outside surface of the vane rotor, to which the hydraulic fluid is supplied. Alternatively, the retard oil passage may be formed in the inner surface of the housing member, and the advance oil passage may be formed in the outside surface of the vane rotor. Furthermore, both the retard oil passage and the advance oil passage may be formed in one of the inner surface of the housing member and the outside surface of the vane rotor.

In the above-described embodiments, the valve timing adjusting device which drives the intake valve has been explained. Alternatively, the valve timing adjusting device may drive only the exhaust valve, or both the intake valve and the exhaust valve.

In the above-described embodiments, the stopper piston moves axially to fit in the fitting ring. Alternatively, the stopper piston may move radially to fit in the fitting ring.

Further, in the above-described embodiments, the driving force to rotate the crankshaft is transmitted to the camshaft through the chain sprocket. Alternatively, driving force may be transmitted through a timing pulley or a timing gear. Further, the driving force of the crankshaft may be received by the vane member to rotate both the camshaft as the driven shaft and the housing member as a single body.

What is claimed is:

1. A valve timing adjusting device which is installed in a driving force transmitting system for transmitting a driving force from a driving shaft of an internal combustion engine to a driven shaft for opening and closing at least one of an intake valve and an exhaust valve, and adjusts the opening-closing timing of at least either one of the intake valve and the exhaust valve, said valve timing adjusting device, comprising:

a housing member rotating together with said driving shaft, said housing member including a peripheral wall and a side wall which is connected with said peripheral wall on an axial end of said peripheral wall, said housing member defining a housing chamber therein-side; and a vane member rotating together with said driven shaft, said vane member including a vane housed in said housing chamber to partition said housing chamber into a retard chamber and an advance chamber in a rotation direction, said vane member driven to rotate by a fluid pressure with respect to said housing member within a range of predetermined angle, wherein said driven shaft includes a fluid supply passage formed to allow a supply of a hydraulic fluid to said retard chamber and said advance chamber; and said housing member defines an inner surface located at one axial side to which the hydraulic fluid is supplied from said fluid supply passage, said vane member defines an outside surface located at one axial side to which the hydraulic fluid is supplied from said fluid supply passage, said inner surface of said housing member faces said outside surface of said vane member in the axial direction, a retard passage communicating with said retard chamber and being capable of supplying the hydraulic fluid to said retard chamber, and an advance passage communicating with said advance chamber and being capable of supplying the hydraulic fluid to said advance chamber are formed in at least one of said inner surface of said housing and said outside surface of said vane member.

2. A valve timing adjusting device according to claim 1, wherein said retard passage is formed in one of said inner surface and said outside surface, and said advance passage is formed in the other of said inner surface and said outside surface.

3. A valve timing adjusting device according to claim 1, wherein at least one of said retard passage and said advance passage is formed in said outside surface of said vane, said housing member includes shoes protruding toward a center of rotation of said housing member and facing an outer peripheral wall of said vane member for forming said housing chamber therebetween, a seal member is mounted on an inner peripheral wall of said shoe to prevent leakage of the hydraulic fluid from said retard chamber and said advance chamber, and within a range of rotatable angle of said vane member with respect to said housing member, said retard passage communicates with said retard chamber, said advance passage communicates with said advance chamber, and said seal member does not reach a communication point where said retard passage communicates with said retard chamber, and a communication point where said advance passage communicates with said advance chamber.

4. A valve timing adjusting device according to claim 3, wherein said retard passage or said advance passage opens at a root portion of said vane, and both corners in the rotation direction of said shoe on a side where said shoe radially faces the outer peripheral wall of said vane member is cut out.

5. A valve timing adjusting device according to claim 1, further comprising a restraining means, said restraining means includes:

a contact portion provided in said vane member;

a counterpart portion provided in said housing member; and an urging means for urging said contact portion toward said counterpart portion, wherein said contact portion contacts said counterpart portion when said vane member is at a predetermined angle position with respect to said housing member, for restraining a rotation of said vane member with respect to said housing member.

6. A valve timing adjusting device which is installed in a driving force transmitting system for transmitting a driving force from a driving shaft of an internal combustion engine to a driven shaft for opening and closing at least one of an intake valve and an exhaust valve, and adjusts the opening-closing timing of at least either one of the intake valve and the exhaust valve, said valve timing adjusting device, comprising:

a housing member rotating together with said driving shaft, said housing member including a peripheral wall and a side wall which is connected with said peripheral wall on an axial end of said peripheral wall, said housing member defining a housing chamber therein-side;

a vane member rotating together with said driven shaft, said vane member including a vane housed in said housing chamber to partition said housing chamber into a retard chamber and an advance chamber in a rotation direction, said vane member driven to rotate by a fluid pressure with respect to said housing member within a range of predetermined angle; and a passage member provided on said housing member and said vane member at a side opposite to said driven shaft, said passage member having a fluid supply passage capable of supplying a hydraulic fluid to said retard chamber and said advance chamber, wherein said housing member defines an inner surface located at one axial side to which the hydraulic fluid is supplied from said passage member, said vane member defines an outside surface located at one axial side to which the hydraulic fluid is supplied from said passage member, said inner surface of said housing member faces said outside surface of said vane member in the axial direction, a retard passage communicating with said retard chamber and being capable of supplying the hydraulic fluid to said retard chamber, and an advance passage communicating with said advance chamber and being capable of supplying the hydraulic fluid to said advance chamber are formed in at least one of said inner surface of said housing and said outside surface of said vane member.

7. A valve timing adjusting device according to claim 6, wherein said retard passage is formed in one of said inner surface and said outside surface, and said advance passage is formed in the other of said inner surface and said outside surface.

* * * * *